US005346433A

United States Patent [19]

Weinreich

[11] Patent Number: 5,346,433

[45] Date of Patent: Sep. 13, 1994

[54] MIRROR ILLUSION

[75] Inventor: Steve Weinreich, Monmouth Jct., N.J.

[73] Assignee: Inventures, Inc., Parsippany, N.J.

[21] Appl. No.: 13,921

[22] Filed: Feb. 5, 1993

[51] Int. Cl.[5] ..... A63J 21/00

[52] U.S. Cl. ..... 472/63; 472/71; 40/443; 40/900

[58] Field of Search ..... 472/63, 71; 40/442, 40/443, 219, 900; 446/219; 362/135, 136, 137, 140

[56] References Cited

U.S. PATENT DOCUMENTS

| | | | |
|---|---|---|---|
| 1,900,059 | 3/1933 | Hayter . | |
| 2,173,939 | 9/1939 | Hall | 40/442 |
| 3,256,014 | 6/1966 | Kelsey | 40/442 |
| 3,868,501 | 2/1975 | Barbour | 40/442 |
| 4,023,794 | 5/1977 | Adams | 472/63 |
| 4,180,931 | 1/1980 | Osch | 40/219 |
| 4,898,560 | 2/1990 | Moscovich | 472/63 |
| 5,014,044 | 8/1991 | Weinreich . | |
| 5,123,192 | 6/1992 | Hsieh | 40/442 |

*Primary Examiner*—Carl D. Friedman
*Assistant Examiner*—Kien Nguyen
*Attorney, Agent, or Firm*—Sherman & Shalloway

[57] ABSTRACT

By a new configuration which more efficiently controls illumination, it is possible to make a mirror dissolve illusion which uses less power than those previously known in the art. A reflector and lamp assembly is provided in front of a partially reflective and partially transparent (one-way) mirror to direct light to a viewer via the one-way mirror. The technique includes use of a backlit wall pattern and a reflective floor surface along with a mirror of reduced density.

25 Claims, 1 Drawing Sheet

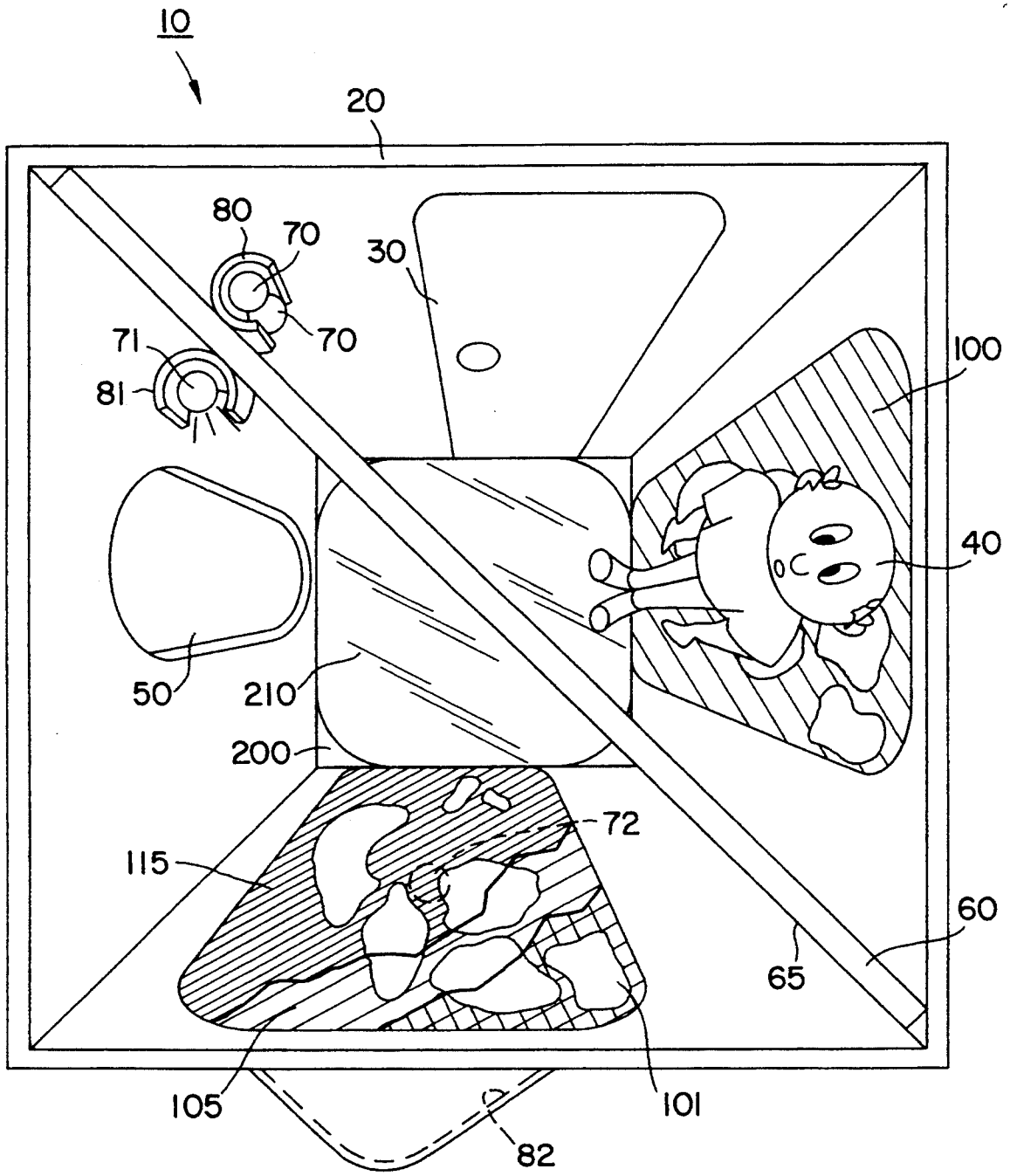
10
20
80
70
30
70
71
81
100
40
50
210
200
72
115
60
65
105
101
82

MIRROR ILLUSION

FIELD OF INVENTION

This invention relates to a vanishing illusion device. More particularly, the invention relates to a vanishing illusion device requiring less illumination power for vanishing an object within the device.

BACKGROUND OF THE INVENTION

It is known in the art to apparently dissolve or vanish an object through the use of a partially silvered mirror, also known as transparent mirror, one-way mirror, magic mirror, or one-way glass, and by other terms. The mirror is typically set at an angle of about 45 degrees between the viewer and object. By decreasing illumination on the object while increasing illumination on the viewer's side of the mirror, the object seems to disappear. This illusion is addressed in Hayter, U.S. Pat. No. 1,900,059, which varies illumination by directing light from a single source alternately to opposite sides of the mirror, and in Weinreich, U.S. Pat. No. 5,041,044, which shows the more common method of dimming one light source while brightening a second source on the opposite side of the mirror. These inventions do not, however, address the efficient use of available illumination.

As stated above illusion devices of the type using a one-way mirror and variable illumination to vanish an object are known. Particularly where such a device is powered by batteries or where cost, size, or heat output limits illuminating power, it is important not to waste that illumination. Many different materials have been used for the "mirror" of this illusion, including smoked glass, neutral density filters, and even clear glass or plastic. The most common material is about 50% transmissive mirror comprising a glass substrate and a "silvering" of vacuum deposited metal, e.g., aluminum.

In typical mirror illusion devices, a mirror giving roughly equal transmission and reflection is used. Typically, the illumination is by sources of equal intensity behind and before the mirror. In operation (neglecting losses), 50% of the light from behind passes through the mirror to the eye of the viewer. As that light is dimmed and the light before the mirror brightens, 50% of the light before the mirror reflects to the viewer's eye. If the reflectivity of the mirror were to be increased, a savings in front illumination would result, but there would be a commensurate increase in required rear illumination. Conversely, a decrease in the reflectivity of the mirror would also require a symmetrical lighting correction.

SUMMARY OF THE INVENTION

The present invention therefore has as a major object a vanishing illusion device which requires less power for effective illumination of the object enabling viewing thereof through a transparent mirror and for illumination on the viewer's side of the mirror to obscure (vanish) the object from the viewer's side of the mirror.

This and other objects of the invention, which will become more apparent from the following detailed description, are achieved by a vanishing illusion device of the type which includes within a housing, a partially reflective and partially transparent mirror.

The vanishing illusion device of this invention includes, within a housing, a partially reflective and partially transparent mirror having a first surface and a second surface, variable illumination means for changing the balance of illumination between the first and second surfaces of the mirror and, means for increasing the amount of light reflected from the first surface of the mirror directly toward a viewer facing the mirror's front surface when the variable illumination means is illuminating primarily the space in front of the mirror, thereby facilitating the obscuring and vanishing illusion of the object. Accordingly, in view of the increased efficiency of directing light to the viewer the vanishing illusion can be effected with less total power requirements for energizing the variable illusion means.

In this regard, as used herein and in the appended claims, the term "variable illumination means" can be any means for alternatively illuminating primarily an object to be vanished (which will be placed to the rear of the mirror) whereby the object may be viewed through the mirror (from the first surface thereof) and illuminating primarily the space in front of the first surface of the mirror to thereby obscure the view of the object through the mirror, thus creating the vanishing illusion. The variable illumination means may, for example, include a single light source directed alternately to opposite sides of the mirror (e.g., U.S. Pat. No. 1,900,059) or separate light sources on either side of the mirror alternately dimmed and brightened, respectively (e.g., U.S. Pat. No. 5,041,044).

According to this invention, the means for increasing the amount of light directed to the viewer includes a source of illumination, e.g., light bulb, placed within a reflector and positioned to throw light directly at the viewer, preferably via the mirror. The intensity of the light is thus far greater than would be achieved by more general illumination. The light/reflector assembly is thus, both a component of the variable illumination means, and the means for increasing the amount of light reflected from the front surface of the mirror directly towards a viewer.

By providing the light reflecting-increasing means, it becomes possible to use with advantage as the partially reflective-partially transparent ("one-way") mirror, one which is only slightly reflective. The scene behind the mirror can, in turn, appear bright with far less light than typically necessary.

A patterned transparency may be placed over the reflector and lamp assembly or may be used independently of the reflector and lamp assembly. The pattern is a mirror image of the back wall of the scene behind the mirror. The illusion benefits by the retention of elements of the scene or area from which the object is to vanish. The pattern primarily aids here, however, by camouflaging any part of the object which may be visible through the slightly reflective mirror after the object has "vanished." This is particularly important where objects of varying color or brightness are to be vanished from the same device.

According to a preferred embodiment of the invention, a reflective surface (other than the one-way mirror) is positioned, with respect to the one-way mirror, to direct light toward a viewer facing the front surface of the one-way mirror.

In still further aspects of the invention the enhancement of the vanishing illusion is further promoted by positioning a neutral density filter to hide a first pattern (i.e., patterned transparency) provided within the housing facing the front surface of the one-way mirror and arranged symmetrically, with respect to the one-way mirror, to, and being a mirror image (reversal) of, a second pattern provided as background for an object to be vanished. Preferably, the first pattern is mounted between the light/reflector assembly and the one-way mirror. When the variable illumination means is operating to illuminate primarily the object the neutral density filter hides the first pattern from being reflected by the one-way mirror. Conversely, when the variable illumination means is primarily, or only, illuminating the space in front of the one-way mirror the reverse image is reflected off the one-way mirror to the observer to enhance the reality of the vanishing object illusion. The neutral density filter may also be provided even without the patterned transparency. In this case, by placing the neutral density filter between the reflector/lamp assembly and the first surface of the mirror it is possible to reduce or eliminate reflection of the reflector (of the reflector/lamp assembly) from the mirror when the variable illumination means is not operating or operating to primarily illuminate an object to be vanished. The neutral density filter, therefore, with or without the patterned transparency, can further reduce the total power requirements for illumination, particularly the illumination of the object to be vanished, and can permit use of a low density (e.g., lightly or non-silvered) mirror.

BRIEF DESCRIPTION OF THE DRAWING

The attached FIGURE is an uncovered top view of the preferred embodiment of the invention.

DETAILED DESCRIPTION OF THE PREFERRED EMBODIMENT

In this invention it is preferred to use aluminum as the reflective material of the partially reflective-partially transparent (one-way) mirror because of its high efficiency in reflecting visible light. The material of the transparent substrate is immaterial. It should be noted that even a very thin silvering, particularly on the first or front surface (the surface facing the viewer) of the mirror serves to overwhelm the second surface reflection that would be apparent if the substrate were not very thin. When silvering is used it is preferably provided on the first surface.

It is desired to use as little power as possible for the reflector and lamp assembly. The power requirement may be easily determined for any particular light/reflector assembly, housing construction, one-way mirror, etc.

In some cases the slightly reflective and transparent mirror may be slightly more reflective than desired or necessary. This can result from cost considerations, materials availability, need to accommodate objects of various attributes, problems with ambient light, and other reasons. In such case, the backlit camouflage pattern should be colorful and complex in order to most effectively do its job. In some cases other considerations of product design may dictate a particular pattern.

If those patterns reflect in the mirror even when the object is supposed to be in full view, the reflection will cause the object to appear partially transparent. That is usually not desirable. Therefore, in this invention, a diffuser, which might ordinarily be used to distribute light behind the patterned transparency, may be placed over the transparency. The pattern is thus muted to be less noticeable.

Although this diffuser placement may be satisfactory in destroying the illusion of a transparent object, a residual whiteness may appear as a fog or fuzziness over the object. Also, in some cases, the diffuser may be insufficient to hide the pattern. Regardless of diffuser placement, a light neutral density filter, is preferably placed over the pattern and diffuser (when used), in order to help perfect the illusion while not appreciably reducing the ability of the reflector and lamp assembly to effectively vanish the object. The neutral density filter by itself or in combination with the diffuser also prevents the pattern from being illuminated by ambient light. Similarly, even in the absence of the pattern, the neutral density filter may be placed in front of the reflector/-lamp assembly to reduce or prevent the reflector from reflecting from the mirror.

An object in a device of this type is seen by the viewer with both a wall and a floor as background to the object. Although the reflector and lamp assembly may form part of both floor and wall (or two such assemblies may be used), due to cost or other design considerations that may not be practical. It is preferred in this invention, therefore, to provide an at least partially reflective floor surface in front of the reflector and lamp assembly. The viewer will then see a reflection of the illuminated floor where the base of the object might otherwise be visible.

In order to preserve the symmetry desired for this illusion, a reflective floor surface is also preferred beneath the object. Other surfaces may be reflective for the same reasons.

In an alternative, but less preferred embodiment of the invention, the positions of the object and the reflector and lamp assembly are reversed and a mirror of particularly high reflectivity is used. This is not preferred, however, particularly because, while placing the object, the viewer will be aware of viewing it through a mirror. Ambient light falling on the object can also be more of a problem in that embodiment.

This invention is particularly useful in conjunction with applicant's previous invention titled, Teleporter, U.S. Pat. No. 5,041,044, the disclosure of which is incorporated herein by reference thereto. In that invention, the vanished object is mechanically displaced while it is invisible. Illumination is then returned to the area whence the object vanished. The interval in which the apparent illumination of the scene is redistributed is therefore disguised as simply a transitory element of the vanishing process.

As shown in the accompanying FIGURE, the preferred embodiment of the vanishing illusion device 10 comprises a housing 20 in which a door 30 provides access for the placement of an object 40 in front of a pattern 100 which may be viewed through a window 50 and mirror 60 with silvered first (front) surface 65 when lamps 70 in a reflector 80 are illuminated. Although a double lamp is shown, only a single lamp, of any desired shape, may be used. Also, one or more additional lamp/reflector combinations may be provided for illuminating the object and rear wall background. Reflector 80 assures that the light from lamps 70 efficiently illuminates objects 40 and does not shine through mirror 60 directly. When one or more additional lamps 70 are provided they should be similarly reflected away from mirror 60. Lamp(s) 70 are preferably battery powered and can be controlled through a variable resistor, switch, or other circuit by ordinary means. The batteries, battery holder, wires, and other common circuit components are not shown.

Also attached to the battery are lamps 71 and 72. They are preferably connected through the control circuit so that as lamps 70 are extinguished, lamps 71 and 72 are turned on.

When lamps 71 and 72 are lit, lamp 71 in reflector 81 provides general or fill illumination to the area in front of the mirror so that the scene does not seem overly unnatural. Lamp 71 and reflector 81 are not required and may be dispensed with entirely, particularly if lamp 72 is sufficiently bright and silvering 65 is not extremely light. In that case, it may also be possible to vanish object 40 without or with only partially extinguishing lamps 70. It is possible, if lamp 72 is sufficiently bright, to dispense with silvering altogether, in which case mirror 60 should be as thin as possible to avoid double reflection. A stretched membrane may be appropriate. It will be appreciated that in the embodiment illustrated in the FIGURE each of lamps 70, 71 and 72 are part of the variable illumination means.

The silvering 65 is preferably about 70% transmissive, and the lamps 70, 71, and 72 are preferably rated at 6 volts and 0.25 amperes for a housing 20 in the shape of a cube preferably about 8 inches on a side. As seen in the FIGURE, mirror 60 is placed at a preferably 45° angle with respect to the viewer (opening 50).

Lamp 72 in reflector 82 preferably provides backlight for transparency pattern 101 (a mirror image of pattern 100) which preferably shows through diffuser 105 and neutral density film 115 to reflect off the silvered first surface 65 of mirror 60 obscuring the view of object 40 through window 50. Illumination from lamp 72 preferably also bounces off reflective surface 210 on floor 200 of housing 20 to assure that the bottom of object 40 is also obscured.

While the invention has been described with reference to the preferred embodiment thereof, it will be appreciated by those of ordinary skill in the art that various modifications can be made to the structure and operation of the invention without departing from the spirit and scope of the invention as a whole.

I claim:

1. A vanishing illusion device for disappearing an object located within the device comprising:

a housing;

a partially reflective and partially transparent mirror within said housing, said mirror having a first surface and a second surface;

an object to be vanished located rearwardly of and facing the second surface of said mirror;

variable illumination means for alternatively illuminating primarily said object to be vanished whereby the object may be directly observed through the mirror from a position facing the first surface of said mirror or primarily the space in front of the first surface of the mirror whereby the object will be obscured from being viewed through the mirror by an observer facing the first surface of the mirror; said variable illumination means comprising a first reflector and lamp assembly positioned to direct light towards a viewer facing the first surface of the mirror to thereby increase the amount of light reflected directly toward such viewer when the variable illumination means is illuminating primarily the space in front of the first surface of the mirror, thereby facilitating the obscuring and vanishing illusion of the object; and a second lamp and reflector assembly located within said housing and adjacent to the second surface of the partially reflective and partially transparent mirror and positioned to illuminate said object to be vanished and said first reflector and lamp assembly positioned to direct light towards a viewer facing the first surface of the mirror via the first surface of the mirror to thereby obscure said object to be vanished from being viewed through the mirror.

2. The vanishing illusion device of claim 1 wherein said first reflector and lamp assembly is positioned to direct light towards the first surface of the mirror whereby the light is reflected from the first surface toward a viewer facing the first surface of the mirror.

3. The vanishing illusion device of claim 1 which further comprises a reflective surface, other than said mirror, and positioned, with respect to said mirror to direct light towards a viewer facing the first surface of the mirror.

4. The vanishing illusion device of claim 3 wherein said reflective surface is located on the floor of said housing.

5. The vanishing illusion device of claim 1 which further comprises a first pattern within said housing.

6. The vanishing illusion device of claim 5 which further comprises means for hiding the first pattern when the first pattern is unilluminated by the variable illumination means.

7. The vanishing illusion device of claim 6 wherein said hiding means comprises a neutral density filter positioned to hide the first pattern when the first pattern is unilluminated by the variable illumination means.

8. The vanishing illusion device of claim 6 wherein said hiding means comprises a diffuser positioned to hide the first pattern when the first pattern is unilluminated by the variable illumination means.

9. The vanishing illusion device of claim 8 which further comprises a diffuser positioned between the neutral density filter and the first pattern, said diffuser further hiding the first pattern when the first pattern is unilluminated by the variable illumination means.

10. The vanishing illusion device of claim 5 or 6 which further comprises a second pattern which is a mirror reversal of the first pattern, the second pattern being mounted in said housing behind said object to be vanished.

11. The vanishing illusion device of claim 10 wherein said first pattern is located within the housing facing the first surface of the mirror and arranged symmetrically to said second pattern with respect to the mirror.

12. The vanishing illusion device of claim 1 further comprising a neutral density filter positioned between the reflector and lamp assembly and the first surface of the mirror.

13. The vanishing illusion device of claim 12 further comprising a reflective surface, other than said mirror, and positioned, with respect to said mirror, to direct light towards a viewer facing the first surface of the mirror.

14. The vanishing illusion device of claim 13 wherein said reflective surface is located on the floor of said housing.

15. The vanishing illusion device of claim 1 wherein said mirror comprises a thin sheet of unsilvered material.

16. The vanishing illusion device of claim 1 wherein said mirror comprises a very lightly silvered transparent substrate.

17. The vanishing illusion device of claim 16 wherein said mirror has a light transmissivity of about 70%.

18. The vanishing illusion device of claim 1 further comprising a third lamp and reflector assembly positioned to provide illumination within the portion of the housing in front of the first surface of the mirror.

19. The vanishing illusion device of claim 1 further comprising a reflective surface, other than said mirror, positioned with respect to the mirror to direct light to a viewer positioned facing the front surface of the mirror.

20. The vanishing illusion device of claim 19 wherein the reflecting surface is located on the floor of the housing and directs light to the viewer by reflection from the front surface of the mirror.

21. The vanishing illusion device of claim 20 further comprising a first pattern mounted behind said object to be vanished and a second pattern which is a mirror reversal of the first pattern with respect to the partially reflective and partially transparent mirror.

22. The vanishing illusion device of claim 21 further comprising a neutral density filter positioned between the second pattern and the mirror to thereby hide the second pattern when it is unilluminated.

23. A vanishing illusion device comprising, a housing;

a partially reflective and partially transparent mirror within said housing, said mirror having a first surface and a second surface;

a reflective surface, other than said mirror, on the floor of said housing, and positioned, with respect to said mirror, to direct light towards a viewer facing the first surface of the mirror; and variable illumination means for alternatively illuminating primarily an object to be vanished located rearwardly of and facing the second surface of said mirror whereby the object may be directly observed through the mirror from a position facing the first surface of said mirror or primarily the space in front of the first surface of the mirror whereby the object will be obscured from being viewed through the mirror by an observer facing the first surface of the mirror; said variable illumination means comprising a reflector and lamp assembly positioned to direct light towards a viewer facing the first surface of the mirror to thereby increase the amount of light reflected directly toward such viewer when the variable illumination means is illuminating primarily the space in front of the first surface of the mirror, thereby together with the reflective surface facilitating the obscuring and vanishing illusion of the object.

24. A vanishing illusion device comprising, a housing;

a partially reflective and partially transparent mirror within said housing, said mirror having a first surface and a second surface;

a first pattern within said housing located forwardly of and facing the first surface of said mirror;

variable illumination means for alternatively illuminating primarily an object to be vanished located rearwardly of and facing the second surface of said mirror whereby the object may be directly observed through the mirror from a position facing the first surface of said mirror or primarily the space in front of the first surface of the mirror whereby the object will be obscured from being viewed through the mirror by an observer facing the first surface of the mirror; said variable illumination means comprising a first reflector and lamp assembly positioned to direct light towards a viewer facing the first surface of the mirror to thereby increase the amount of light reflected directly toward such viewer when the variable illumination means is illuminating primarily the space in front of the first surface of the mirror, thereby facilitating the obscuring and vanishing illusion of the object; and means for hiding the first pattern when the first pattern is unilluminated by the variable illumination means.

25. The vanishing illusion device of claim 24 further comprising an object to be vanished.

* * * * *